US007841162B2

(12) United States Patent
Coombs

(10) Patent No.: US 7,841,162 B2
(45) Date of Patent: Nov. 30, 2010

(54) YARNS, PARTICULARLY YARNS INCORPORATING RECYCLED MATERIAL, AND METHODS OF MAKING THEM

(75) Inventor: Timothy S. Coombs, New York, NY (US)

(73) Assignee: Return Textiles, LLC, New York, NY (US)

( * ) Notice: Subject to any disclaimer, the term of this patent is extended or adjusted under 35 U.S.C. 154(b) by 1023 days.

(21) Appl. No.: 10/564,223

(22) PCT Filed: Jul. 12, 2004

(86) PCT No.: PCT/US2004/022262

§ 371 (c)(1),
(2), (4) Date: Jan. 10, 2006

(87) PCT Pub. No.: WO2005/007944

PCT Pub. Date: Jan. 27, 2005

(65) Prior Publication Data

US 2006/0185343 A1 Aug. 24, 2006

Related U.S. Application Data

(60) Provisional application No. 60/486,037, filed on Jul. 10, 2003.

(51) Int. Cl.
*D02G 3/02* (2006.01)
*D02G 3/22* (2006.01)

(52) U.S. Cl. ..... 57/210; 57/224; 57/230

(58) Field of Classification Search ..... 57/210, 57/224, 230
See application file for complete search history.

(56) References Cited

U.S. PATENT DOCUMENTS

| | | | | |
|---|---|---|---|---|
| 4,137,698 | A | 2/1979 | Tillman | |
| 4,290,260 | A * | 9/1981 | Wasserman | 57/210 |
| 4,350,731 | A | 9/1982 | Siracusano | |
| 4,525,992 | A | 7/1985 | Payen | |
| 4,614,081 | A | 9/1986 | Kim | |
| 4,840,021 | A * | 6/1989 | Guevel et al. | 57/210 |
| 4,914,902 | A | 4/1990 | Keefe, Jr. | |
| 4,976,096 | A * | 12/1990 | Sawhney et al. | 57/12 |
| 5,383,331 | A | 1/1995 | Proctor | |
| 5,481,863 | A | 1/1996 | Ota | |
| 5,487,941 | A * | 1/1996 | Pepin | 428/364 |

(Continued)

OTHER PUBLICATIONS

Oxenham, "Fasciated Yarns—A Revolutionary Development?" Journal of Textile and Apparel, Technology and Management, vol. 1, Issue 2, Winter 2001, pp. 1-7.

(Continued)

*Primary Examiner*—Shaun R Hurley
(74) *Attorney, Agent, or Firm*—Polster, Lieder, Woodruff & Lucchesi, L.C.

(57) ABSTRACT

Enhanced performance yarns which are functional alternatives to 100% petroleum oil based virgin continuous filament yarns, and yarns of natural fibers and methods of making them. The yarns may comprise an inner portion of spun staple fibers of recycled plastic and an outer portion comprising a different material and incorporate highly significant amounts of recycled plastics, particularly post consumer recycled, thermoplastic material such as polyethylene terephthalate which contains medium to high levels of contamination. One embodiment of yarn comprises a core, an inner portion of spun staple fibers surrounding the core, and an outer portion comprising an inner helix and an outer helix.

33 Claims, 4 Drawing Sheets

U.S. PATENT DOCUMENTS

| | | | | |
|---|---|---|---|---|
| 5,572,860 | A * | 11/1996 | Mitsumoto et al. | 57/224 |
| 5,735,110 | A | 4/1998 | Kruger et al. | |
| 5,749,212 | A * | 5/1998 | Rees et al. | 57/225 |
| 5,768,875 | A | 6/1998 | Bergen | |
| 5,960,621 | A | 10/1999 | Scheerer et al. | |
| 6,088,892 | A | 7/2000 | Bertsch et al. | |
| 6,250,060 | B1 | 6/2001 | Scheerer et al. | |
| 6,370,858 | B1 | 4/2002 | Mori | |
| 6,405,519 | B1 | 6/2002 | Shaikh et al. | |
| 6,410,140 | B1 * | 6/2002 | Land et al. | 428/377 |
| 6,655,122 | B2 | 12/2003 | Shigeyama et al. | |
| 6,679,043 | B2 | 1/2004 | Griesshammer et al. | |

OTHER PUBLICATIONS

Oxenham, "Developments in Spinning," TextileWorld.com, May 2003, 6 pages.

16 Code of Federal Regulations § 303.7 (Dec. 1, 2000).

Digicone® Preciflex™ DP3-C, SSM Schärer Schweiter Mettler AG (undated).

* cited by examiner

YARNS, PARTICULARLY YARNS INCORPORATING RECYCLED MATERIAL, AND METHODS OF MAKING THEM

CROSS-REFERENCE TO RELATED APPLICATIONS

This application is a national phase application under 35 U.S.C. § 371 of PCT international application No. U.S.2004/022262, filed Jul. 12, 2004, which claims the benefit of U.S. Provisional Application 60/486,037, filed Jul. 10, 2003, which is incorporated by reference herein.

TECHNICAL FIELD

The present invention relates to yarn filament configuration, yarn fiber combination, yarn spinning techniques, and ecologically friendly and functionally sustainable textile design solutions.

BACKGROUND OF THE INVENTION

The present invention may be understood in light of the following state of the art.

Ever since processes of converting crushed plastic bottles made of polyethylene terephthalate (PET) into fiber for textiles was proposed as a substitute for virgin polyester, attempts have been made to commercialize the processes. However, development of filaments, staple fiber, yarn, and fabric for the purposes of expanding the potential end uses of these fibers has been relatively limited. This has been attributed primarily to the inherently high cost of acquiring a clean raw material source. When one uses polymer made from the inherently impure post consumer recycled (PCR) polyethylene terephthalate (PCR-PET), one is limited to staple spun yarn rather than a continuous filament yarn because of the unpredictable weak points in monofilaments caused by the impurities. Practical uses for the staple spun yarn have been limited.

When particular domestic-based end use product manufacturers brought products containing fabric made from recycled plastic bottles to market and charged a premium for a product that had inherent quality deficiencies, they were unable to sustain significant enough market demand for these products to merit the expansion of plastic bottle fiber production. Instead, the fiber mills, which had originally predicted growth In market consumption of the fiber, were forced to close fiber plants that were originally supplying these domestic-based end use product manufacturers with their fiber.

Therefore, a longstanding need has existed for an economical method of utilizing PCR-PET to manufacture useable yarn of high quality.

Several highly cost-intensive PCR-PET purification methods now exist which are able to almost eradicate contamination from the recycled materials stream. They produce food-grade materials, and such materials might be suitable for producing continuous filament yarn. Because of their cost, however, they are not presently useful for producing commercially viable fiber.

The manufacture of yarn, whether in the form of thread or higher denier yarns, is one of the oldest technologies known. Numerous manufacturing methods are known for making continuous filament yarns, for combining continuous filaments into yarns, and for making yarns from shorter, staple fibers. Spinning staples into yarns has been known since prehistory.

Today, the three most popular spinning frames for staple spun yarn are ringspun, open end, and air jet. Prior to air jet, ringspun was considered the best in terms of quality and strength. Open end spinning has always been considered to be cheap and fast. Air jet is now hailed by most industry experts to be the optimal type of spinning frame for almost any application. Air jet spinning produces a fasciated yarn including a sheath of generally axially aligned staples bound together with discontinuous generally helical bundles of staples. Air jet machines are expensive; however their output speeds even at fine counts make them the best solution from an economic standpoint. From the standpoint of performance, the air jet produces the lowest pill yarn ever spun. The only complaint thus far is that the strength of an air jet yarn is slightly less than the strength of a ringspun yarn; however, this issue is easily overcome by placing a filament core inside the air jet yarn. The general rule for staple fiber going into air jet spinning frames is that it should be between about 1.2 and 2.0 inches (3 to 5 cm) in length, preferably between about 1.2 and 1.7 inches (3 to 4.3 cm) in length, and most preferably about 1.5 inches (3.8 cm) in length. Diameter of the staples can range from about 0.5 to about 2.0 denier per filament (dpf). A variant of an air jet spinning frame is known as a vortex spinning frame. A vortex spinning frame is capable of spinning a wider range of natural staple fibers, including cotton fibers, than is easily obtained with the earlier forms of air jet spinning frames. The vortex spinning frame produces a three-dimensional cotton sheath having better hand than does the basic air jet frame. It is also faster.

Air jet spinning frames are well known in the art. Air jet spinning is presently dominated by Murata Kikal KK of Kyoto, Japan. Its MJS air jet spinning machine, MTS twin spinning machine, and MVS vortex spinning machines are widely used and their details are known to those skilled in the art. Such machines are described for example in Oxenham, "Fasciated Yarns—A Revolutionary Development?" Journal of Textile and Apparel, Technology and Management, Vol. 1, issue 2, Winter 2001, pp. 1-7; Oxenham, "Developments In Spinning," TextileWorld.com, May 2003; and in numerous patents, such as Shaikh et al., U.S. Pat. No. 6,405,519 ; Scheerer et al, U.S. Pat. No. 6,250,060; Scheerer et al., U.S. Pat. No. 5,960,621; Ota, U.S. Pat. No. 5,481,863; Griesshammer et al., U.S. Pat. No. 6,679,043; Shigeyarni et al., U.S. Pat. No. 6,655,122; and Mori, U.S. Pat. No. 6,370,858.

Other yarns include those in which a core is covered with a continuous filament helix using a covering machine (sometimes called coverwrapping machine or wrapping machine). These machines are traditionally used to cover spandex or other continuous filament stretch yarns. A single or double helix is applied by a standard covering machine. Covering machines are occasionally used to cover non-stretch continuous filament cores to produce "fancy" yarns for small niche markets or industrial yarns. Such machines are sold by a number of manufacturers, for example by Rieter/ICBT, now known as the Filament Yarn Technologies Group, of Rieter Machine Works, Ltd., Winterthur, Switzerland. They are also widely described in the patent literature, for example in Siracusano, U.S. Pat. No. 4,350,731; Tillman, U.S. Pat. No. 4,137,698; and Payen, U.S. Pat. No. 4,525,992.

Continuous filament yarns are sometimes texturized (also called textured) by a texturizing machine to give them particular surface or geometrical properties. For example, a filament may be given a "false twist" by twisting it, heating it, cooling it, and then untwisting it, or it may be given a more random shape by the several high-speed air methods described in Bertsch et al., U.S. Pat. No. 6,088,892. 1 Surface features are given by other methods, known to those skilled in the art. Generally, texturizing yarn filaments is done for the purpose of giving a synthetic (plastic) yarn some of the characteristics of a natural fiber.

Synthetic yarns are generally superior to yarns made of natural fibers in tenacity (tensile strength), abrasion resistance, quick-drying properties, and dimensional stability, but they generally lack the hand, drape, and moisture absorbance of their natural fiber counterparts. It is frequently desirable to produce yarns having special characteristics such as fire retardancy, high moisture permeability, bacterial resistance, ultraviolet ray resistance, low surface friction, or special aesthetic texturing. Generally, providing one of these characteristics requires compromising other characteristics of a synthetic or natural yarn. For example, high tenacity synthetics such as polyarnides including aromatic polyarnides (aramids) and high-tenacity aliphatic polyarnides (nylon), carbon, or glass provide much higher tenacities than many other synthetics or most natural fibers, but they lack many desirable characteristics as a yarn for numerous fabrics. Aramids provide greater tenacity than high-tenacity nylons, but they are susceptible to ultraviolet radiation. Providing other characteristics in a high-tenacity synthetic yarn generally reduces the tenacity of the yarn.

SUMMARY OF THE INVENTION

The present invention produces enhanced performance yarns which comprise, and are functional and economic alternatives to, 100% petroleum oil based virgin continuous filament yarns, such as polyesters (like virgin polyethylene terephthalate), polyarnides (like nylon and aramids), polyolefins (like polypropylene and polyisobutylene), fluorocarbons (like polytetrafluoroethylene), high tenacity nylon, high tenacity polyester, and yarns formed of regenerated natural materials (like rayon and acetate). A list of man-made fibers, all of which are to some extent useable with embodiments of the present invention is contained in ISO Standard 2076: 1999(E) and in United States 16 Code of Federal Regulations part 303, particularly §303.7 (Dec. 1, 2000), both incorporated by reference. The invention also produces enhanced performance yarns which comprise, and are functional and economic alternatives to, natural spun vegetable yarns (like cotton, linen, hemp, jute, and bamboo), silk yarns, and wool and other animal fiber yarns. These yarns are achieved by way of new yarn filament configurations and yarn manufacturing methods which, among other things, provide a sustainable avenue to incorporate highly significant amounts of recycled plastics, particularly post consumer recycled (PCR) thermoplastic material such as polyethylene terephthalate (PET), which contains medium to high levels of contamination, into a yarn without sacrificing many if any of the performance characteristics or properties that are inherent to the related competing alternate yarn type. The alternate yarn type may be, for example, 100% petroleum oil based virgin continuous filament yarn or may be natural or synthetic staple spun yarn.

Corespun yarns with a continuous filament core, a spun sheath of recycled thermoplastic such as PCR-PET, and a spun cover formed either with an air jet (Including vortex Jet) machine or a cover wrapping machine are particularly advantageous. Other yarns and methods of making them also fall within the purview of the present invention, as will be understood by those skilled in the art in light of the following description, drawings, and claims.

Only post consumer recycled polyethylene terephthalate (PCR-PET) which in its pre-extruded liquid form contains substantial enough levels of contamination to prevent it from remaining in a continuous filament at post extrusion due to the unpredictable points of weakness caused by the inherent impurities contained within the polymer, is economically logical for use in a staple form.

in present economic conditions, the cleanest PCR-PET pre-extruded liquid polymer that this invention is appropriate for accommodating can not run through a filament extrusion hole smaller than seventeen to twenty microns. Another way of stating this is that a suitable pre-extruded liquid PCR-PET, in a standard pressure drop test, requires a pressure of greater than about 100 pounds per square inch (psi) for a twenty micron opening in order to be economically viable. Typically, the pressure drop of suitable pre-extruded PCR-PET will be about 500 psi or less for use in an extruder having a 20 micron opening and producing a 1.2 dpf staple. If the liquid polymer is pure enough to economically run through an extrusion hole smaller than seventeen microns in a manufacturing operation, then it is likely to have a more appropriate use elsewhere than in producing staple fiber, even staple fiber for use in the present invention. Larger diameter staple, extruded through a larger hole, may be used with other spinning methods.

DESCRIPTION OF THE PREFERRED EMBODIMENTS

The embodiments of the present invention described below are not meant to be limiting of the invention but to illustrate presently preferred embodiments.

EXAMPLE 1

Preparation of an Intermediate Yarn

Figure 1:
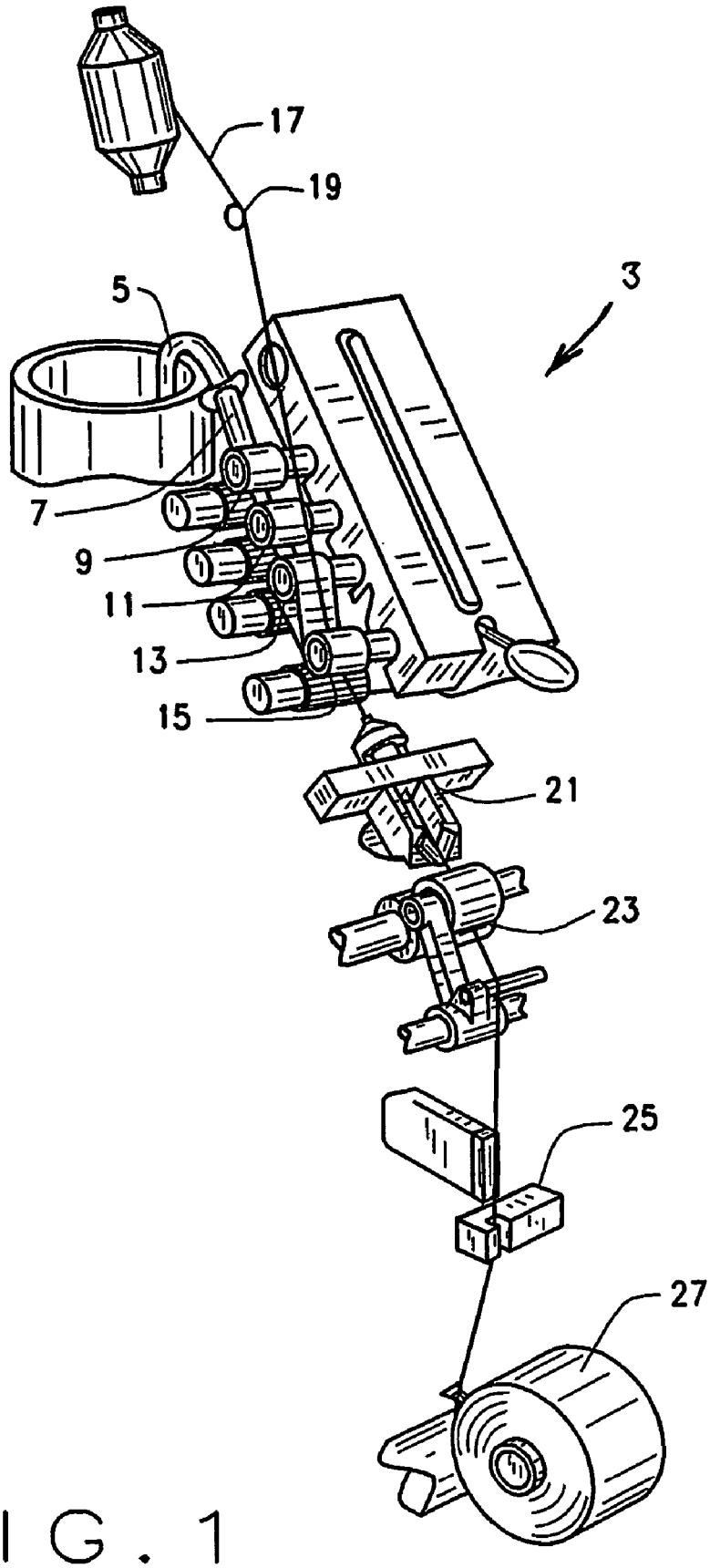
FIG. 1 is a schematic view of a standard commercially available air jet spinning machine for use in performing steps of preferred embodiments of the present method.
Figure 2:
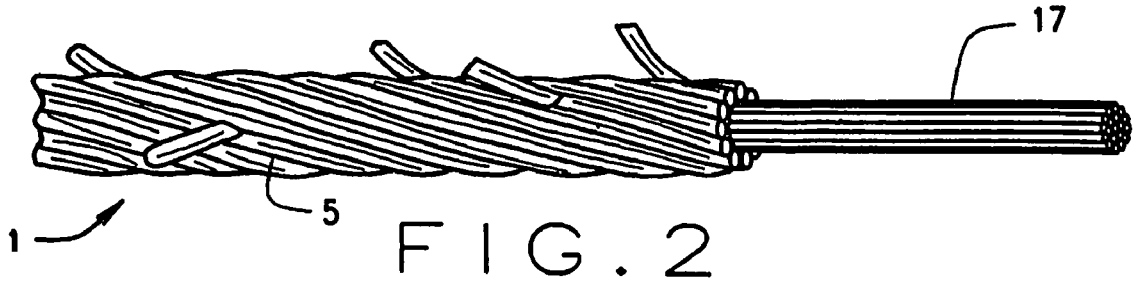
FIG. 2 is a view in side elevation, partially cut away, of the yarn produced by the machine of FIG. 1.

Referring now to the drawings, and in particular to FIGS. 1 and 2, a preferred form of an intermediate yarn 1 for use in some illustrative preferred embodiments of the present invention is produced on a standard Murata MJS or MVS spinning frame 3. The spinning frame 3, as is well known in the art, includes a sliver supply 5 which feeds sliver through a trumpet 7, into a drafting zone. Sliver is staple which is processed by a carding machine into a solid controllable and soft form. The drafting zone comprises a pair of back rolls 9, a pair of middle rolls 11, a pair of apron rolls 13, and a pair of front rolls 15. If desired, a guide or condenser may be included between the back rolls 9 and middle rolls 11.

As shown in FIG. 1, the spinning frame 3 is set up with a standard core attachment for inclusion of a core. A continuous filament core yarn 17 is fed through a pigtail guide 19 into the spinning frame at the forward end of the drafting zone, at front rolls 15.

The front rolls 15 feed the core yarn 17 and drafted sliver into a spinning zone comprising spinning nozzles 21 and delivery rolls 23 which form the sliver into a spun sheath surrounding and hiding the core yarn 17 in accordance with well-known principles.

The completed corespun yarn 1 is passed through a yarn clearer 25 and rolled onto a core package 27.

The corespun yarn 1 which forms an intermediate yarn for use in the present invention is shown in FIG. 2. In this illustrative embodiment, the sliver 5, hence the spun sheath 5 of the yarn 1 is formed of PCR-PET having a staple length of about 1.5 inches (3.8 cm) and a diameter of about 0.7 to 2 denier. The PCR-PET is cleaned sufficiently to be suitable for the formation of staple fibers but not continuous filament. The continuous filament core is illustratively formed of a high tenacity multifilament bundle, illustratively high tenacity nylon having a tenacity rating of about fifteen. The functions of the core and sheath will be discussed hereinafter in connection with particular constructions of the invention utilizing this intermediate yarn 1.

EXAMPLE 2

Production of a Wrapped PCR-PET Yarn

Figure 3:
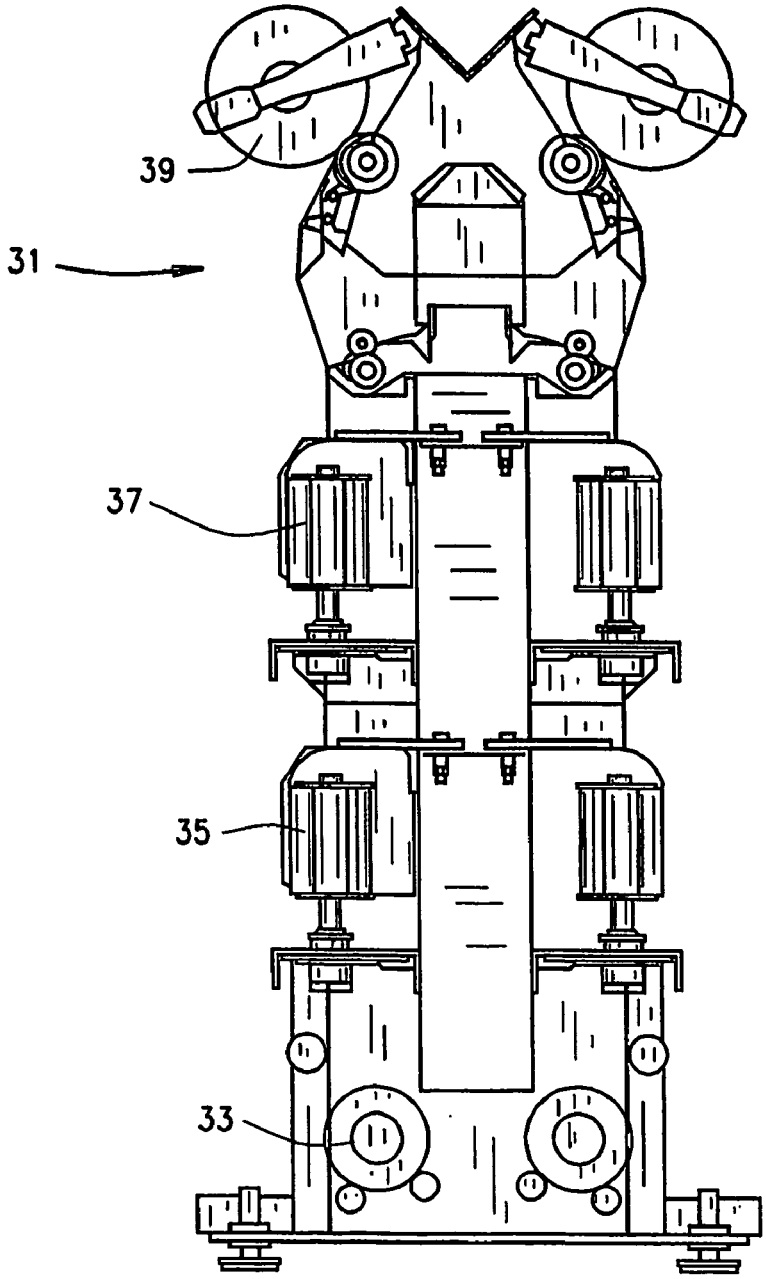
FIG. 3 is a schematic view of standard commercially available machine for winding a covering thread around a core.

As shown in FIG. 3, a standard coverwrapping machine 31, modified for use with the intermediate corespun yarn 1, is used for this step. The coverwrapping machine is illustratively a Model G-307-UE covering machine sold by Rieter/ICBT (Filament Yarn Technologies Group, Rieter Machine Works, Ltd.). The machine is adjusted to accept the intermediate corespun yarn 1, which differs in construction and physical properties from the usual elastomer (spandex) core fed into the machine. The intermediate yarn 1 is placed on the supply rolls 33 of the covering machine 31, from which it is fed to a first covering station 35 which applies an inner helix of an inner cover yarn, then to a second covering station 37 which applies an outer helix of an outer cover yarn, wrapped in a direction opposite the first helix. The completed yarn of this embodiment is then rolled on takeup rolls 39. The outer helix forms the outer cover, which is the surface of the completed yarn.

Figure 4:
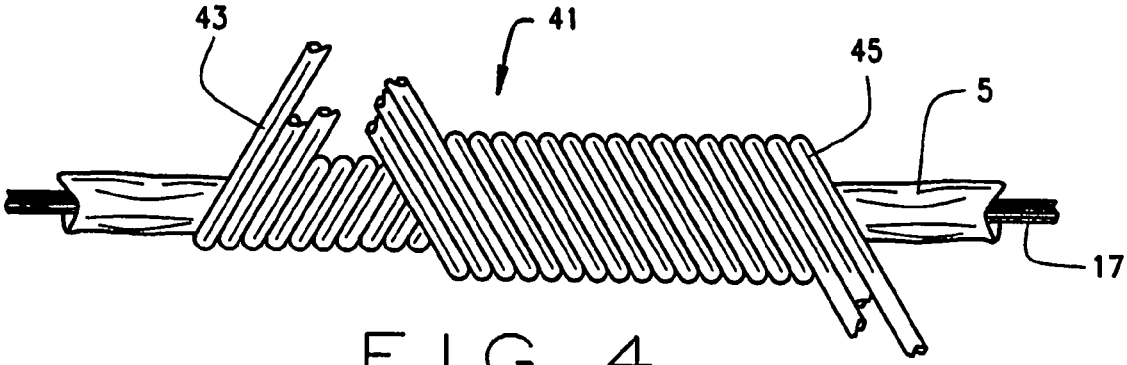
FIG. 4 is a view in side elevation, partially cut away, of a yarn of this invention produced from the yarn of FIG. 2 by the machine of FIG. 3.

As shown in FIG. 4, the completed yarn 41 includes a double helix composed of two continuous filament yarns, an inner helix yarn 43 and an outer helix yarn 45, which together form a cover that wraps around the outside of the sheath of the corespun yarn 1.

The continuous filament core 17 acts as a central load bearing point for the entire yarn. In other embodiments of this construction, the filament type of the core 17 can be stretch, high tenacity or standard polymer. The presently preferred core material is high tenacity nylon or polyester, a combination of the two, or a combination of one of the two fiber types with another high tenacity or standard continuous filament yarn possessing a grams per denier tenacity rating between 8 and 35. To date, the optimal core judged from the standpoint of achieving a high strength without generating a high cost, is a high tenacity polyester or high tenacity nylon continuous filament. The core can compose anywhere from 10% to 50% of the total weight of the finished yarn. However, the optimal percentage of the core when using high tenacity nylon or high tenacity polyester, is presently believed to be between 10% and 20%.

The sheath 5 has two main functions, the first being its inherent ability to be a highly compressible component in the yarn, and the second being a sustainable avenue for incorporating a recycled material component in the yarn without affecting the yarn's performance properties.

The sheath is illustratively composed of post consumer recycled polyethylene terephthalate (PCR-PET) staple length fiber. The optimal cut staple length is 1.5-3.0 inches, and the optimal staple dpf (denier per filament) ranges between 0.8 and 3.0 depending on the amount of fibers per cross-section required by the yarn's thickness.

The double helix has two main functions. The first is to provide a surface layer for the yarn having desired aesthetic characteristics and functional characteristics. The second is to interact mechanically with the core and sheath to provide surprising physical characteristics to the completed composite yarn.

In the illustrative embodiment of yarn, the main functions of the double helix is to give the yarn extremely high resistance to abrasion, protecting the inherently less abrasion resistant sheath 5. Either high tenacity or standard tenacity nylon is recommended because of its traditionally high abrasion resistance properties. It will be seen that the yarn type of the wrap yarns 43 and 45 can be customized to accommodate the special needs of a particular end use application. When the yarn 41, or a fabric formed from it, needs to have special properties such as fire retardancy, high moisture permeability, bacterial resistance, ultraviolet ray resistance, low surface friction, or special aesthetic texturing, a continuous filament yarn containing any of these mentioned special properties can be selected as the "wrap yarn" to best suit the needs of the yarn end use application. Depending on several variables, different or the same type of continuous filament or spun yarn can be used as the inner and or outer layer helix. Also, the amount of Individual filaments of which the wrap yarn is composed can play a large role in the cover's aesthetic, handling, and physical characteristics. Therefore, for end use applications in which abrasion resistance is paramount, it is best to use a wrap yarn with as few individual filaments as possible. It is even recommended to use a monofilament, so that the entire wrap yarn is composed of one filament. However, when the amount of total individual filaments in the yarn is limited, the yarn and fabric become progressively more rigid as fewer filaments are used in the wrap yarns.

The second function of the double helical cover is to participate in a physical relationship with the core and sheath to provide unexpected physical characteristics, particularly unexpectedly high tenacity.

Although not wishing to be bound by theory, I believe that the double helix wrapped corespun yarn combines the known physics concepts of compression and expansion to form an otherwise unexplainably strong strand of yarn. The standard logic in yarn manufacturing suggests that a high tenacity continuous filament yarn equaling the same diameter as the yarn of this example would be stronger because the yarn of this example is illustratively composed of 17% high tenacity continuous filament core, 43% inherently weaker standard-tenacity polyester staple sheath (PCR-PET), and 40% standard or high tenacity continuous filament yarn which forms the double helix. However, testing of a fabric of this example compared to a 100% high tenacity nylon continuous filament fabric of the equivalent denier proved the new yarn to have higher tenacity than the control fabric.

My interpretation of the interaction of the core, the sheath, and the cover is as follows.

A) The sheath made from staple length fibers is inherently lofty because the structure of a sheath consists of many small fibers spun together which creates tiny air pockets in-between the staples. One way to potentially increase the amount of sheath loft is to use a hollow staple fiber in the sheath; however this could potentially add cost and depending on the degree in which the hollow staple increases the overall strength of the yarn, it may or may not be of great value. Nevertheless, the use of a hollow staple fiber may achieve an even higher tenacity strength rated yarn.

B) The double helix is applied through a mechanical wrapping machine which wraps the two continuous filament wrap yarns tightly around the sheath simultaneously in opposite directions. When the helix yarns wrap, they compress the sheath, and in doing so push out all the air trapped between individual staple fibers. The act of compression alters the original shape and orientation of the sheath's internal structure, in turn forcing the sheath to inherently and continuously attempt to expand. In the sheath's effort to expand, it is consistently applying equivalent amounts of pressure to both the core and the helix. This distribution of pressure compounds the originally separate elements of core, sheath and double helix into one unified strand which has exceptional strength. A fabric composed of yarn made in accordance with this embodiment of the invention has now been tested to have 30% higher grams per denier tenacity levels than a similar fabric made of 100% high tenacity nylon continuous filament of the equivalent denier.

The turns per inch (TPI) is a measure of the density of the cover or double helix within one inch of the yarn. The TPI can greatly affect the degree of abrasion resistance generated by the double helix, and can also greatly affect the degree of grams per denier tenacity rating of the yarn. TPI can be converted into what is known as coverage percentage, meaning the percentage of the surface being wrapped that is covered by the wrap yarns. Higher wrap coverage percentages equal higher yarn abrasion resistance and higher yarn tenacity ratings. They also equal longer processing time and higher cost. Optimal double helix wrap coverage is between 70% and 100%.

EXAMPLE 3

First Alternative Yarn Construction

This construction and the construction of the following Example comprise a high tenacity, standard tenacity, or stretch continuous filament yarn core and a uniquely formed sheath. The sheath comprises two layers of distinctly different staple fiber types. The layers are constructed such that there is an inner layer which touches the core, and an outer layer which is essentially the yarn's exterior surface area. The inner sheath comprises PCR-PET staple length fiber. The outer sheath layer comprises an interchangeable and customizable staple fiber which has specific performance or aesthetic properties or attributes required by the end use application of the yarn.

The choice between the method of this Example and that of the following Example depends on what the needs of the end use application are, as discussed below.

Figure 6:
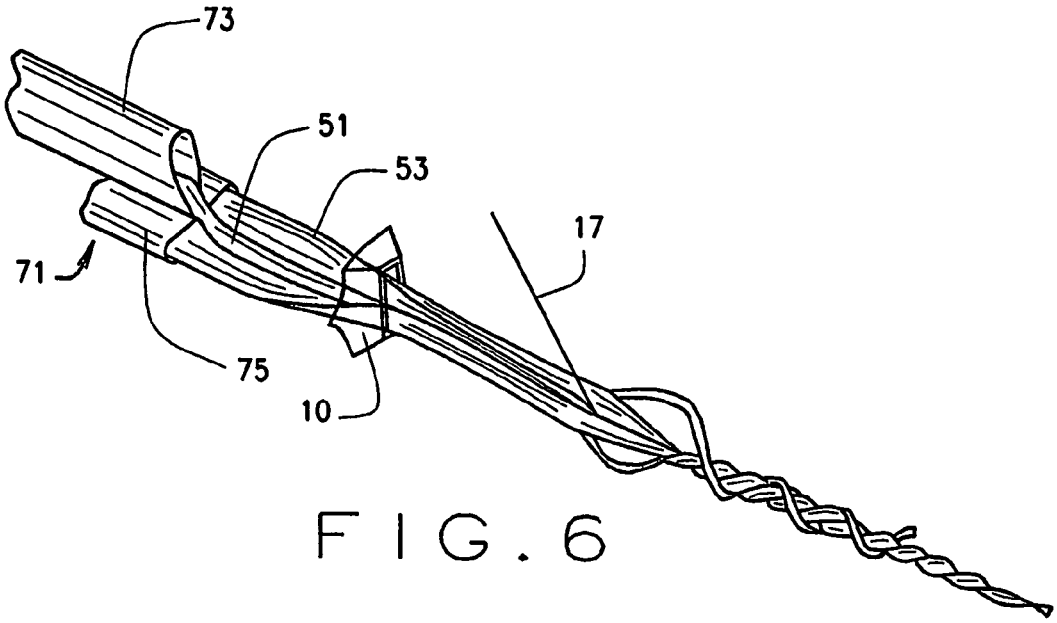
FIG. 6 is a somewhat schematic detailed view of part of the machine of FIG. 5, showing two types of sliver emerging from an outlet of a T-trumpet portion of the machine and being formed into a yarn of this invention.
Figure 7:
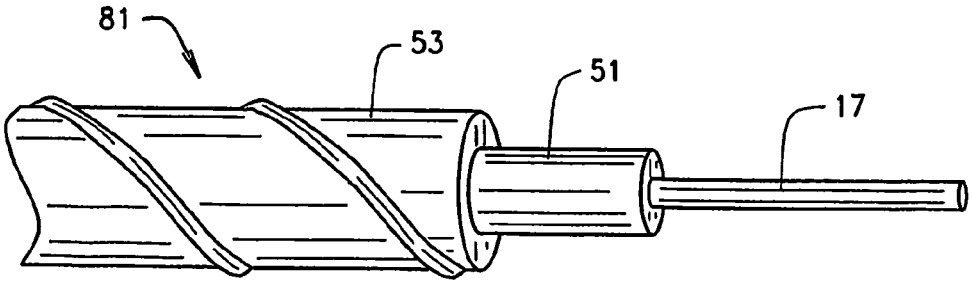
FIG. 7 is a view in side elevation, partially cut away, of a yarn of this invention produced by the machine of FIGS. 5 and 6.
Figure 5:
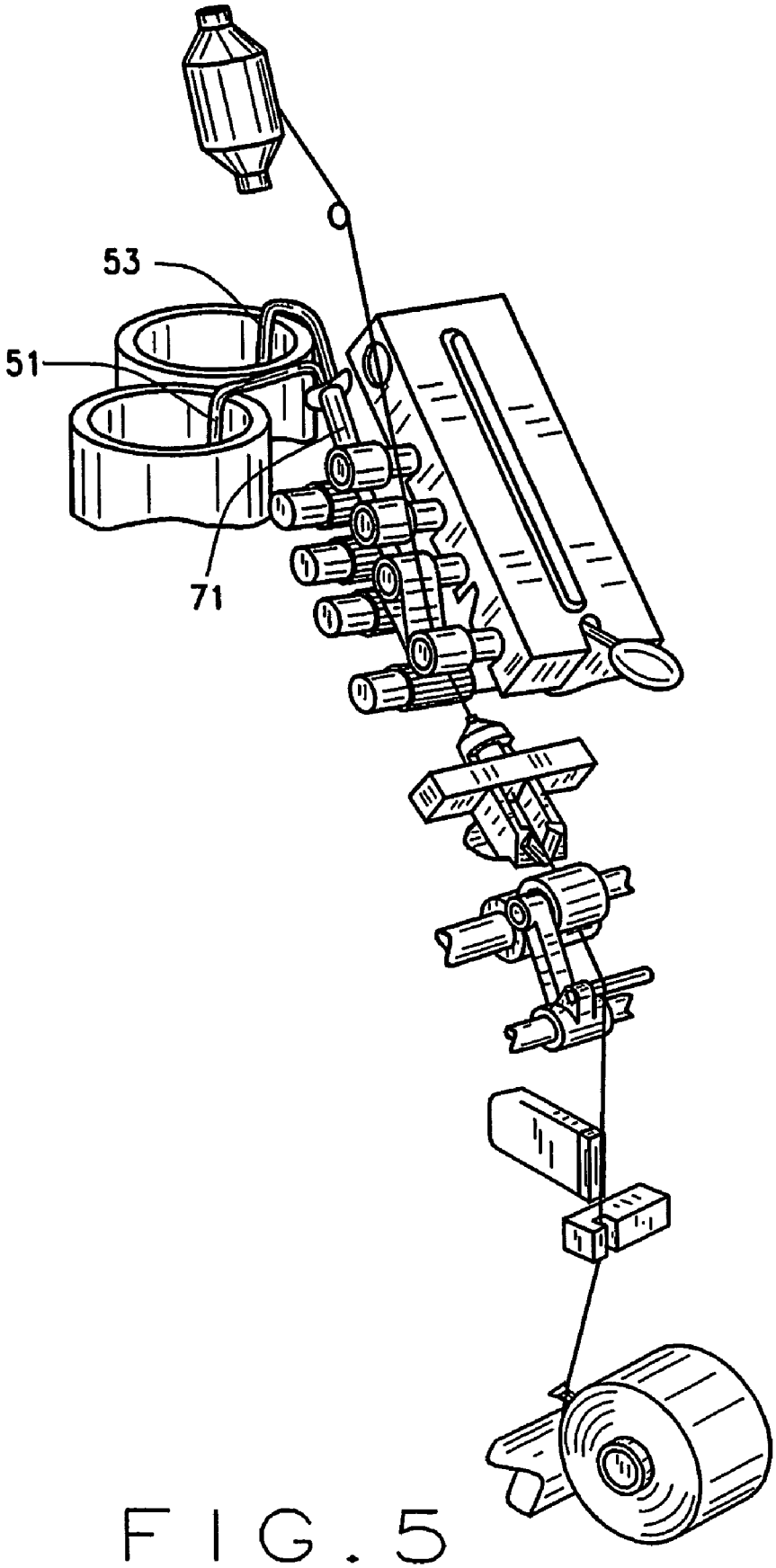
FIG. 5 is a schematic view of a standard commercially available air jet spinning machine modified for use in performing steps of preferred embodiments of the present method.

The manufacturing method of this Example utilizes a Murata MJS or MVS spinning machine similar to that utilized in Example 1. l Like the method of Example 1, it inserts a standard or high tenacity continuous filament ucoren by the use of a core attachment. It differs in that it produces a two-layer sheath which is created by the use of a T-trumpet 71. The functional distinguishing feature of this method is its ability to control the placement of sliver. The T-trumpet 71, unlike the standard trumpet 7 normally used to feed carded staple into the spinning frame, allows the feeding of two different types of carded sliver 51 and 53 into the spinning frame in such a way that one fiber type is placed on the inside of the yarn's sheath and another fiber type on the outside of the yarn's sheath. The T-trumpet 71 is shown in more detail in FIG. 6, where the inner sheath sliver 51, illustratively PCR-PET, is emerging from the vertical arm 73 of the T-trumpet, and the outer sheath sliver 53, Illustratively standard or high tenacity nylon, is emerging from the horizontal arm 75 of the T-trumpet. As shown in FIG. 6, a condenser 10 is included between the back rolls 9 and middle rolls 11. When spun by the nozzles 21, the outer edges of the silver 53 become the outer portion of the outer sheath of the finished yarn 81, and the sliver 51 becomes the inner sheath surrounding the core 17, as shown in FIG. 7.

This method will not produce a 100% differentiation of inner and outer sheath fiber types; however, it will be very close. A small amount of the sliver 51 will migrate into the outer sheath, and a small amount of the sliver 53 will migrate into the inner sheath. Any yarn chosen to be manufactured with this method will have the ability to tolerate a less than perfect fiber differentiation. In fact the only time where this differentiation becomes important is when the yarn or fabric is color dyed and the two sheath materials require different dyes. For example, with a cotton exterior sheath and the standard polyester interior sheath, the cotton will be dyed with a cotton dye; however, the polyester will remain white and unaffected by the cotton dye. Therefore, a polyester dye must be used either simultaneously or separately along with the cotton dye in order to achieve color uniformity.

This manufacturing technique is suitable for all end use products except those which are being indigo dyed. Exterior sheath staple fibers which are compatible with this spinning technique include, for example, high tenacity fibers (such as high-tenacity nylon, glass, carbon, and aramid), low friction fibers, antimicrobial fibers, moisture management fibers (such high moisture permeability fibers and moisture repelling fibers), and natural fibers (such as cotton, wool, silk, rayon, and linen), or any blend of these fibers. Many of these fibers are characterized by having inherently long lengths or by being unpredictable in length due to the fact that they are natural fibers. Because of these characteristics, prior to spinning, fibers substantially shorter than 1.5 inches (3.8 cm) must be removed, and fibers substantially longer than 1.5 inches (3.8 cm) must be cut to 1.5" (3.8 cm) length. The central reason for this is that the optimal spinning frame for these yarns is a Murata MJS or MVS (Murata Machinery, Ltd.), and these machines require a 1.5" (3.8 cm) staple length. However, it has been found that shorter fibers tend to migrate to the outside of the yarn and longer fibers tend to migrate Inward. Therefore, the amount of intermingling of fibers in the sheath may be minimized by including at least some slightly shorter staples in the sliver for the outside sheath (perhaps somewhat longer than 1.2 inches) to fill the outside sheath, while eliminating such shorter staples in the sliver for the inner sheath. It may also be possible, although it is not presently preferred, to use modify the sliver for the inner sheath by adding slightly longer sliver (perhaps somewhat shorter than 1.8 inches) or by intermixing a little of the shorter staples of the fibers of the outer sheath.

The key reason why the use of Murata's air jet technology is preferred over ringspun technology, is that the Murata air jet yarn manufacturing process involves among other elements, a portion of the fiber which is channeled to the side; while the remainder of the fibers are twisted together in one direction; the channeled fiber acts independently by rapidly wrapping itself around the fiber in twist formation. The critical thing to recognize here, is that the wrapping fibers are not only the fastener of the "false twist", but in this case, because of the fiber control provided by the T-trumpet, these fibers are an entirely different fiber type than the fibers which are being falsely twisted and being wrapped.

EXAMPLE 4

Second Alternative Yarn Construction

This technique is characterized by its ability to be used in indigo dye applications such as denim. The unique circumstance with denim is that the yarn used in denim is dyed with indigo dye while still in yarn form. The yarn is dipped in indigo dye and then aired. The reason for this is that by performing this dip and air procedure you allow only the surface cotton fibers of the yarn to absorb the indigo dye. This becomes important when the woven fabric is stonewashed. During subsequent stone washing some of the indigo dye contained in the surface cotton fibers is beaten out of the fabric, allowing the undyed white interior of the yarn/fabric to come into sight. This in turn gives the fabric a faded appearance.

In order to adapt my yarn design to be applicable to indigo dyed yarn and fabric manufacturing, a technique of yarn spinning is required which enables the yarn to have an outer sheath which consists 100% purely of one fiber type, which in the case of denim is essential to performing the stonewashing of the indigo dyed cotton without having a visible color variation.

The manufacturing method of this Example comprises using the Intermediate corespun yarn 1 of Example 1, containing a high tenacity, standard tenacity, or stretch continuous filament yarn core and a PCR-PET staple fiber sheath, as the core of a second corespun yarn. The intermediate yarn 1 is fed into the machine of FIG. 1, and the sliver is whatever staple fiber is desired as the pure 100% surface of the yarn 81 and of a fabric woven or knit from it.

EXAMPLE 5

High Strength Multifilament Yarn Construction

A continuous and multi-filament yarn having a total denier of 12 to 800 and consisting of 10 to 90% by weight of continuous high tenacity and high modulus monofilaments such as aramid, glass, carbon, or any other fiber filament which has a tenacity higher than 15 and a modulus higher than 500 is provided for use as a core in the foregoing Examples, as a ripstop grid, and for other purposes. The high tenacity, high modulus fiber will be intermingled with monofilaments having a lower tenacity, lower modulus, such as high tenacity nylon, regular nylon, high tenacity polyester, regular polyester, or any other continuous filament fiber having a tenacity rating between 5 and 15. l The ratio of the higher than 15 tenacity fiber to the lower than 15 high tenacity fiber is determined by the strength requirements of its end use application and the actual tenacity ratings of the fibers which are being intermingled.

The yarn forms a particularly good core for the PCR-PET sheath yarns of other embodiments of the invention, as well as being an outstanding ripstop yarn used in forming a ripstop grid in a high-strength fabric.

All the patents and articles mentioned herein are described as an integral part of this disclosure with regard to the technical disclosure and are incorporated herein by reference.

Numerous variations in the methods and products of this Invention, within the scope of the appended claims, will occur to those skilled in the art in light of the foregoing disclosure. Merely by way of example, the core materials, sheath materials, and (in the construction of Example 2) cover materials may all be varied to meet particular requirements. The core of the yarn of Example 2 may be omitted, although it is believed that its omission will weaken the yarn. The intermediate yarn 1 may be formed by other spinning methods, as may the sheaths of Examples 3 and 4, although the methods disclosed are believed to provide superior yarns. Staple fibers having a larger range of lengths and diameters may be utilized if other spinning frames are used. These variations are merely illustrative.

The invention claimed is:

1. A yarn suitable for weaving or knitting into fabric, the yarn comprising an inner portion of spun staple fibers of post consumer recycled (PCR) polyethylene terephthalate (PET) formed from a pre-extruded liquid polymer insufficiently pure to pass through a twenty micron opening without clogging it and an outer portion comprising fibers selected from the group consisting of fire retardant fibers, moisture management fibers, bacterial resistant fibers, ultraviolet ray resistant fibers, low surface friction fibers, textured fibers, high-tenacity fibers having a tenacity greater than five grams per denier, nylon, aramid, and natural fibers.

2. The yarn of claim 1 wherein the PCR-PET comprises at least about 30 percent by weight of the yarn.

3. The yarn of claim 1 further comprising a continuous filament core.

4. The yarn of claim 3 wherein the core comprises a high tenacity material having a tenacity greater than five grams per denier.

5. The yarn of claim 4 wherein the core has a tenacity between 8 and 35 grams per denier.

6. The yarn of claim 3 wherein the core has a texturized surface.

7. The yarn of claim 3 wherein the core is corespun, the core comprising at least one continuous filament and spun staples surrounding the filament.

8. The yarn of claim 3 wherein the core is a stretch material.

9. The yarn of claim 1 wherein the yarn is a fasciated yarn.

10. The yarn of claim 1 wherein the outer portion comprises spun staple fibers.

11. The yarn of claim 1 wherein the outer portion comprises a continuous helically wrapped cover yarn.

12. The yarn of claim 11 wherein the cover yarn comprises a continuous filament.

13. The yarn of claim 12 wherein the cover yarn is a monofilament.

14. The yarn of claim 1 wherein the outer portion comprises two helically wrapped cover yarns, wrapped in opposite directions.

15. The yarn of claim 11 wherein the cover yarn comprises a spun yarn.

16. A yarn comprising an inner portion of spun staple fibers of post consumer recycled (PCR) polyethylene terephthalate (PET) formed from a pre-extruded liquid polymer insufficiently pure to pass through a twenty micron opening without clogging it and an outer portion comprising an inner helix and an outer helix, at least one of the inner helix and outer helix comprising fibers selected from the group consisting of fire retardant fibers, moisture management fibers, bacterial resistant fibers, ultraviolet ray resistant fibers, low surface friction fibers, textured fibers, high-tenacity fibers having a tenacity greater than five grams per denier, nylon, aramid, and natural fibers.

17. A yarn comprising a core formed of at least one strand of a continuous filament having a tenacity of at least about five grams per denier, a sheath of staple fibers surrounding the core, the sheath comprising PCR-PET, and a cover comprising an inner helix and an outer helix, the outer helix being formed of a material different from the inner helix, the outer helix comprising fibers selected from the group consisting of fire retardant fibers, moisture management fibers, bacterial resistant fibers, ultraviolet ray resistant fibers, low surface friction fibers, textured fibers, high-tenacity fibers having a tenacity greater than five grams per denier, nylon, aramid, and natural fibers.

18. A fabric woven or knitted of the yarn of claim 17.

19. The fabric of claim 18 wherein the fabric has a tensile strength greater than that of a fabric formed of the core material of a denier equal to the denier of the yarn.

20. A method of forming a yarn containing staple fibers of PCR plastic formed from a pre-extruded liquid polymer insufficiently pure to pass through a twenty micron opening without clogging it, comprising spinning a plastic-surfaced yarn from the staple fibers of PCR plastic, and thereafter forming a cover over the plastic surfaced yarn with a cover wrapping machine or an air jet machine , the cover comprising fibers selected from the group consisting of fire retardant fibers, moisture management fibers, bacterial resistant fibers, ultraviolet ray resistant fibers, low surface friction fibers, textured fibers, high-tenacity fibers having a tenacity greater than five grams per denier, nylon, aramid, and natural fibers.

21. A method of producing a spun yarn comprising two layers of sheath over a continuous core, the method comprising simultaneously feeding two different staple fibers into a spinning device to simultaneously form the two layers over the core, an inner layer over the core being predominantly PCR-PET and the other layer being predominantly a fiber selected from the group consisting of fire retardant fibers, moisture management fibers, bacterial resistant fibers, ultraviolet ray resistant fibers, low surface friction fibers, textured fibers, high-tenacity fibers having a tenacity greater than five grams per denier, nylon, aramid, and natural fibers.

22. The method of claim 21 wherein the staple fibers are fed through a T-trumpet.

23. The method of claim 21 wherein the other fiber is a natural fiber.

24. A method of producing a spun yarn comprising two layers of sheath over a continuous filament core, the method comprising forming an intermediate yarn by feeding a first staple fiber into a spinning device to form a sheath of the first staple fiber over the core, the first staple fiber being PCR-PET, and thereafter feeding a second staple fiber into a spinning device to form a sheath of the second staple fiber over the intermediate yarn , the second staple fiber being selected from the group consisting of fire retardant fibers, moisture management fibers, bacterial resistant fibers, ultraviolet ray resistant fibers, low surface friction fibers, textured fibers, nylon, aramid, and natural fibers.

25. The method of claim 24 wherein the second fiber comprises a natural fiber.

26. The method of claim 25 wherein the second fiber is cotton.

27. A corespun yarn comprising a core and two sheaths over the core, the first sheath being formed of spun staple fibers of PCR-PET, the second sheath comprising a minor portion of the material of the first sheath in addition to at least one other material selected from the group consisting of fire retardant fibers, moisture management fibers, bacterial resistant fibers, ultraviolet ray resistant fibers, low surface friction fibers, textured fibers, high-tenacity fibers having a tenacity greater than five grams per denier, nylon, aramid, and natural fibers.

28. A method of producing a yarn comprising a core, a sheath, and a cover, the method comprising forming an intermediate yarn by feeding a first staple fiber into a spinning device to form a sheath of the first staple fiber over the core, the first staple fiber comprising PCR-PET, and thereafter feeding the intermediate yarn into a cover wrapping machine or an air jet machine to form at least one helix of a continuous yarn around the intermediate yarn.

29. The method of claim 28 comprising forming an inner helix and an outer helix around the intermediate yarn.

30. A yarn comprising an inner portion of spun staple fibers of post consumer recycled (PCR) polyethylene terephthalate (PET) formed from a pre-extruded liquid polymer insufficiently pure to pass through a twenty micron opening without clogging it and an outer portion comprising two helically wrapped cover yarns, wrapped in opposite directions, the outer portion covering from 70% to 100% of the surface of the inner portion , the outer portion comprising fibers selected from the group consisting of fire retardant fibers, moisture management fibers, bacterial resistant fibers, ultraviolet ray resistant fibers, low surface friction fibers, textured fibers, high-tenacity fibers having a tenacity greater than five grams per denier, nylon, aramid, and natural fibers.

31. The yarn of claim 30 further comprising a continuous filament core.

32. The yarn of claim 14 wherein the outer portion covers from 70% to 100% of the surface of the inner portion.

33. The method of claim 20 wherein the cover is formed over the plastic surfaced yarn with a cover wrapping machine.

* * * * *

UNITED STATES PATENT AND TRADEMARK OFFICE
Certificate

Patent No. 7,841,162 B2 Patented: November 30, 2010

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Timothy S. Coombs, New York, NY (US); and Tyson J. Toussant, New York, NY (US).

Signed and Sealed this Twenty-First Day of August 2012.

SHELLEY SELF
*Supervisory Patent Examiner*
Art Unit 3765
Technology Center 3700